US005397288A

United States Patent [19]

Sayre

[11] Patent Number: 5,397,288

[45] Date of Patent: Mar. 14, 1995

[54] RESILIENT EXERCISE DEVICE HAVING PAIR OF HANDLES AND PROTECTIVE SPINE

[76] Inventor: Cotter W. Sayre, 22026 Wyandotte St., Canoga Park, Calif. 91303

[21] Appl. No.: 227,728

[22] Filed: Apr. 14, 1994

[51] Int. Cl.[6] ..... A63B 21/02

[52] U.S. Cl. ..... 482/125; 482/126; 482/122

[58] Field of Search ..... 482/121, 122, 125, 126, 482/124, 129, 127, 909, 120, 115, 116, 117, 118, 119, 64

[56] References Cited

U.S. PATENT DOCUMENTS

| | | | |
|---|---|---|---|
| 3,445,109 | 5/1969 | Kolbel | 482/125 |
| 3,822,061 | 7/1974 | Sigma | 482/126 |
| 3,885,789 | 5/1975 | Deluty et al. | 482/120 |
| 4,376,533 | 3/1983 | Kolbel | 482/125 |
| 4,591,150 | 5/1986 | Mosher | 482/125 |
| 4,762,318 | 8/1988 | Phillips et al. | 482/126 |
| 4,852,874 | 8/1989 | Sleichter, III et al. | 482/122 |
| 5,031,906 | 7/1991 | Jang | 482/125 |
| 5,242,353 | 9/1993 | Cole et al. | 482/129 |

OTHER PUBLICATIONS

Bollinger Industries' "Chest Pull", 1994 Catalog, p. 40.

*Primary Examiner*—Richard J. Apley
*Assistant Examiner*—Lynne A. Reichard

[57] ABSTRACT

A lightweight, compact, portable exercise device which is self contained and capable of a multitude of exercises. The device comprising a resistance band assembly, existing of a resistance band, a hard rubber spine, and an outer jacket. Attached to one end of the resistance band assembly is a resistance adjust handle, comprising a molded grip shell, a one-step resistance adjust knob and twin integrated foldable handgrips. Attached to the opposing end of the resistance band assembly is the resistance meter assembly, comprised of a molded grip shell, a resistance meter assembly, and twin footrests. The integration of the molded grip shells, hand grips, and foot rests make the unit capable of a large range of exercises, while the one-step resistance adjust knob and resistance meter assembly make resistance adjustments simple and precise.

1 Claim, 6 Drawing Sheets

RESILIENT EXERCISE DEVICE HAVING PAIR OF HANDLES AND PROTECTIVE SPINE

BACKGROUND OF INVENTION

1. Background—Field of Invention

This invention relates to a compact, lightweight, portable exercise device capable of allowing the user to perform various exercises.

2. Background—Description of Prior Art

Heretofore lightweight, portable exercise devices of this type have had no exercise versatility, no one-step tension adjustment (or no adjustment at all), a lack of a tension meter, and exposed resistance means, usually in the form of a coiled spring (such as Bollinger Industries' "Chest Pull"). All prior art of this type refers to the performance of chest exercises, or "upper body workouts"—while my invention is of the same size, weight, and dimensions as the prior art, it has the versatility to perform a multitude of exercises, both upper and lower body, through the use of hand and foot rests integrated with a molded grip shell, along with one step tension adjustment with clearly defined tension levels, and an enclosed resistance means. The need for a compact, lightweight, portable, versatile, and low cost exercise device for the traveler as well as the apartment or house dweller concerned with physical fitness is filled by this invention.

SUMMARY OF THE INVENTION

The invention relates to an improved exercise device that uses easily adjustable force resistors to obtain varied resistance levels, unlike the prior art, which uses the replacement or removal of coiled springs to attain this result.

Another object of this invention is to provide a lightweight, compact, and completely portable device that supplies the user with a safe, effective, varied and low cost muscle toning workout.

A still further object of this invention is to supply a readily apparent and convenient means for judging the resistance level set by the user.

A still further object of this invention is to provide a device that is simple to manufacture, that uses common materials, and is thus inexpensive to construct and purchase.

A still further object of this invention is to provide a readily storable device for users who would normally not be able to use full size exercise devices due to space or monetary limitations.

Still further objects and advantages of the invention will become apparent from consideration of the ensuing description and drawings.

BRIEF DESCRIPTION OF THE DRAWINGS

FIG. 1 is a view embodying the basic external features of the invention.

FIG. 2 is a view of an additional embodiment of the invention of FIG. 1.

FIG. 3 is a view in detail of a resistance adjust handle 1.

FIG. 4 is a view in detail of a resistance meter handle 2.

FIG. 5 is a view in detail of a resistance adjust assembly 12.

FIG. 6 is a view in detail of a resistance meter assembly 14.

FIG. 7 is a view in detail of a resistance band assembly 3.

FIG. 8 is an additional embodiment of a resistance adjust assembly 12.

FIG. 9 is an additional embodiment of resistance adjust handle 1 comprising the additional embodiment of FIG. 8.

DESCRIPTION OF THE PREFERRED EMBODIMENT

Figure 1:
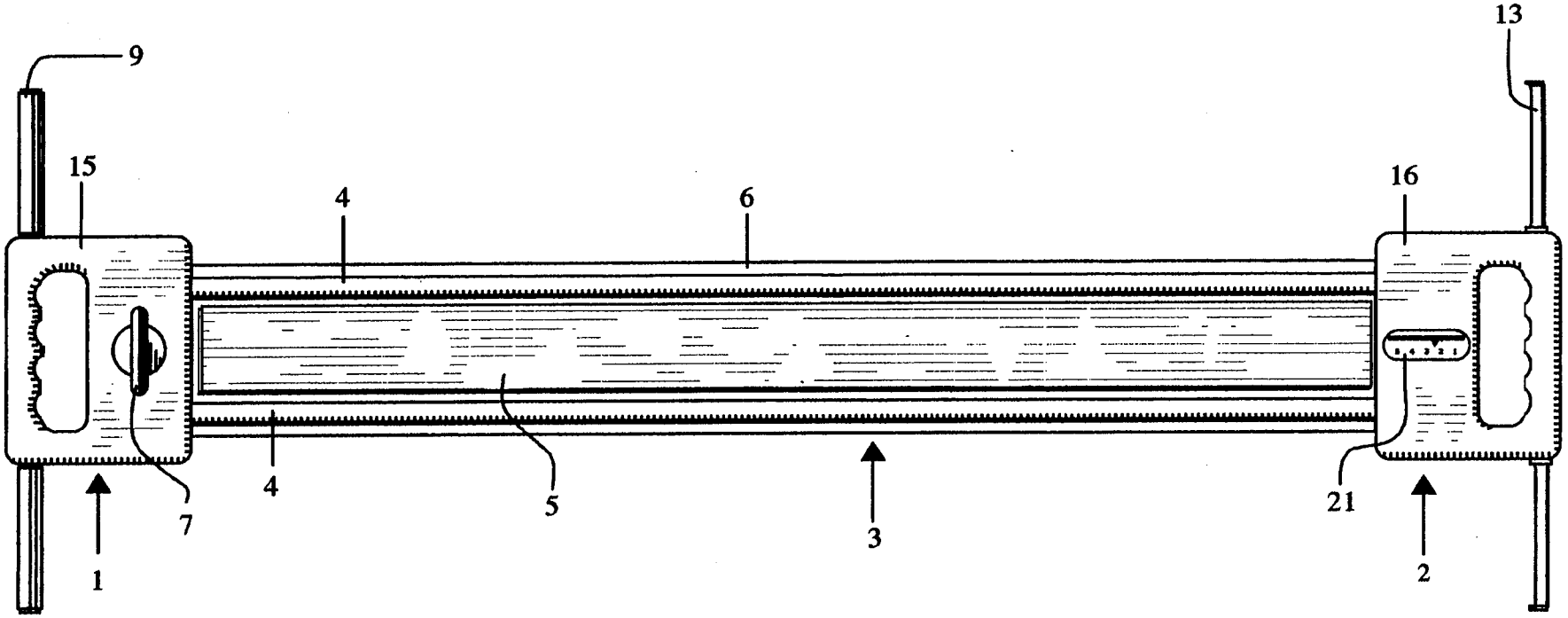
Referring to FIGS. 1, 2, 3, 4, 5, 6, 7, 8, 9, an embodiment of the invention is shown.

In this embodiment, referring to FIG. 1, resistance adjust handle 1 and the resistance meter handle 2 are shown attached to the resistance band assembly 3 by the pressure exerted by the clamping action of a two-part molded grip shell "A" 15 and a two-pan molded grip shell "B" 16 on the resistance band assembly's 3 outer jacket 6, as well as by the tension of the resistance band assembly's 3 internally located resistance band 4. Resistance adjust knob 7 located on the resistance adjust handle 1 is for user control of the variable resistance of the resistance band 4, which is covered by the outer jacket 6. A hard rubber spine 5, enclosed by the outer jacket 6, is used to evenly space the resistance adjust handle 1 from the resistance meter handle 2, yet allow the device to flex during use. A resistance meter plate 21 and the resistance meter assembly 14 (FIGS. 4 and 6) is attached to the resistance meter handle 2 to allow the user a visual indication of the resistance setting of the device. Two hand grips 9 are attached to the molded grip shell "A" 15 by pins, rivets or any convenient means, so as to be foldable from the molded grip shell "A" 15 or, when applicable, to be folded back into the molded grip shell "A" 15. Two foot rests 13, which are attached to the molded grip shell "B" 16 by pins, rivets or any convenient means so as to be foldable from the molded grip shell "B" 16 or, when applicable, to be folded back into the molded grip shell "B" 16.

Figure 2:
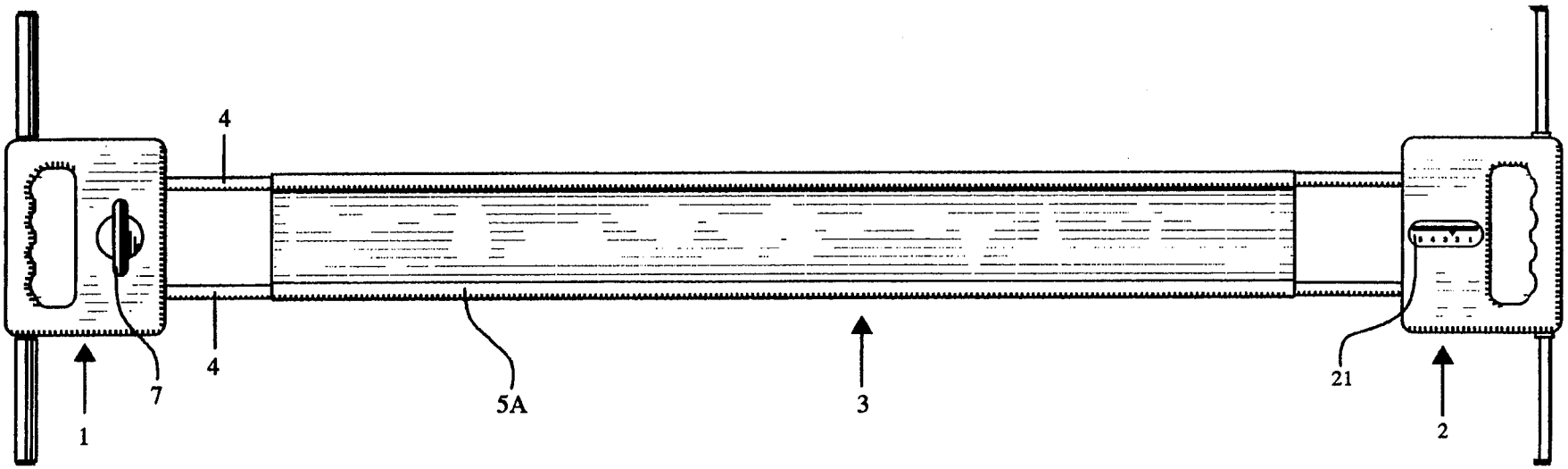

Referring to FIG. 2 is an additional embodiment of the invention of FIG. 1 showing the invention slightly extended, with the resistance adjust handle 1 and the resistance meter handle 2 attached to the resistance band assembly 3 by the tension of the resistance band assembly's 3 resistance band 4. The resistance adjust knob 7 located on the resistance adjust handle 1 is for user control of the variable resistance of the resistance band 4, which is covered by a double channel hard rubber spine 5A, with the resistance band 4 freely movable through the upper and lower channels of the double channel hard rubber spine 5A, which is further used to evenly space the resistance adjust handle 1 from the resistance meter handle 2, yet allow the device to flex during use. The resistance meter plate 21 and internal the resistance meter assembly 14 (FIGS. 4 and 6) is attached to the resistance meter handle 2 to allow the user a visual indication of the resistance setting of the device. The hand grips 9 are attached to the molded grip shell "A" 15 by pins, rivets or any convenient means, so as to be foldable from the molded grip shell "A" 15 or, when applicable, to be folded back into the molded grip shell "A" 15. The foot rests 13, which are attached to the molded grip shell "B" 16 by pins, rivets or any convenient means so as to be foldable from the molded grip shell "B" 16 or, when applicable, to be folded back into the molded grip shell "B" 16.

Figure 3:
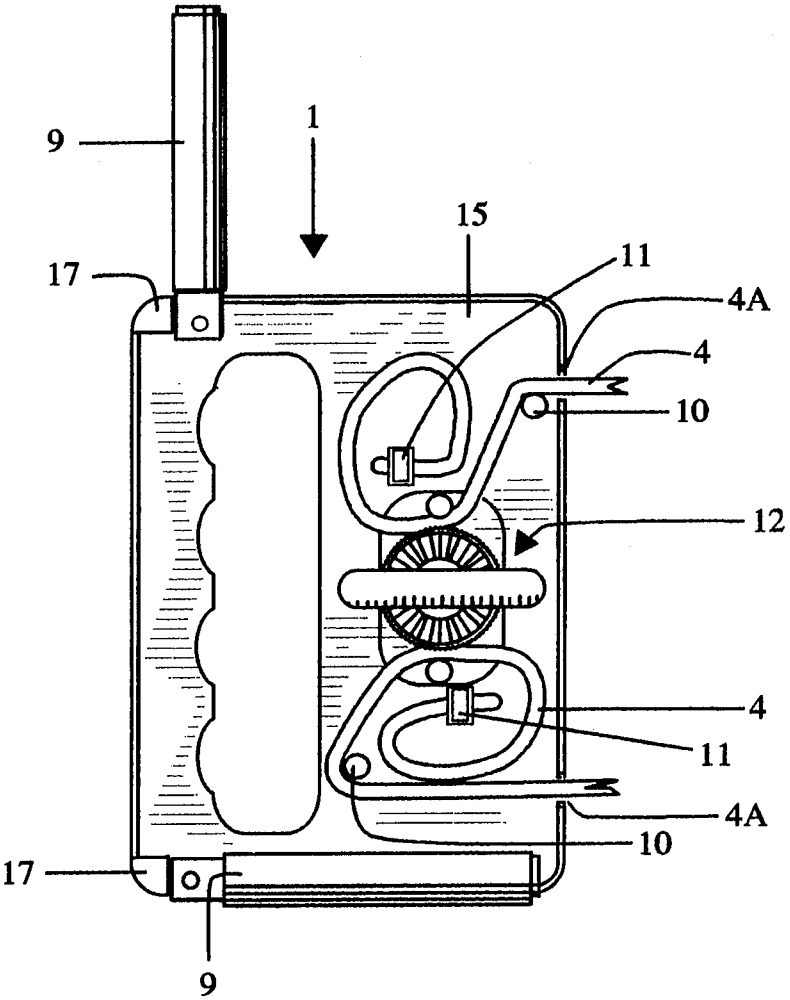

Referring to FIG. 3 the resistance adjust handle 1 is comprised of two hand grips 9 that are attached to the molded grip shell "A" 15 by pins, rivets or any convenient means, so as to be unfolded from the molded grip shell "A" 15 and be held in a 90 degree angle from the molded grip shell "A" 15 by a pivot stop 17, or, when applicable, to be folded back into the molded grip shell "A" 15. A resistance adjust assembly 12 controls the tension of the resistance band 4 and is beast shown is FIG. 5. A stop 11 prevents the user from rotating the resistance band 4 out of the resistance adjust assembly 12, while guides 10 spaces both upper and lower parts of the resistance band 4 between resistance band cutouts 4A.

Figure 4:
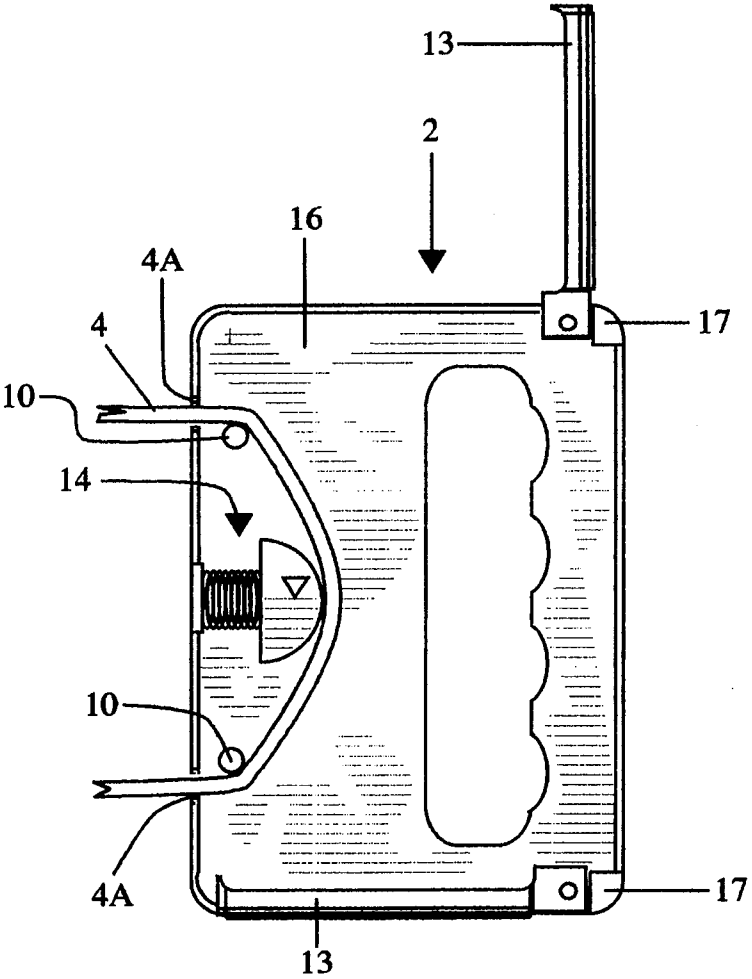

Referring to FIG. 4, the resistance meter handle 2 is comprised of the foot rests 13, which are attached to the molded grip shell "B" 16 by pins, rivets or any convenient means so as to be foldable from the molded grip shell "B" 16 and be held in a 90 degree angle from the molded grip shell "B" 16 by the pivot stop 17. The guides 10 spaces both upper and lower parts of the resistance band 4 between the resistance band cutouts 4A. The resistance meter assembly 14 is best shown in FIG. 6.

Figure 5:
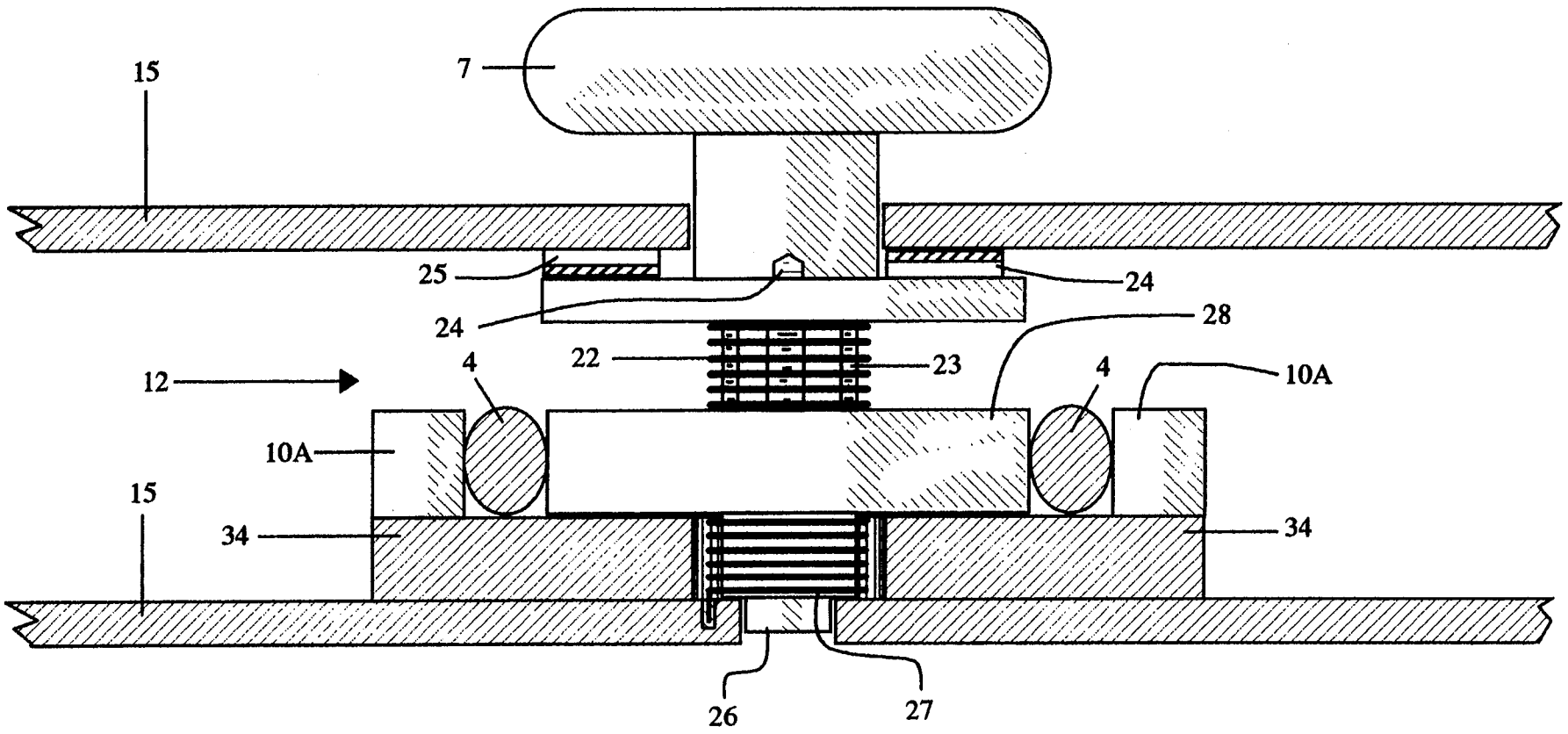

Referring to FIG. 5 the resistance adjust assembly 12 controls the tension of the resistance band 4 by the pushing down of the resistance adjust knob 7, which rides on a fluted shaft 23, against the pressure of a return spring 22, disengaging an ellipse of upper teeth 25, attached to the molded grip shell "A" 15, from an ellipse of lower teeth 24, attached to the lower section of the resistance adjust knob 7, and then the rotation of the resistance adjust knob 7, turning the fluted shaft 23, which is firmly attached to a toughened wheel 28 by any convenient means, rotating the roughened wheel 28 either against the spring tension of the counter spring 27 if lowering tension of the resistance band 4, or with the spring tension of the counter spring 27 if increasing tension of the resistance band 4, thus pinching the resistance band 4 against opposing pinch guides 10A, allowing for the increasing or decreasing of the tension of the invention through friction. The fluted shaft 23 is coupled and rotatable through the lower portion of the molded grip shell "A" 15 by an integral shaft axle 26, while a riser 34 encloses the counter spring 27 and is a platform for the rest of the resistance adjust assembly 12.

Figure 6:
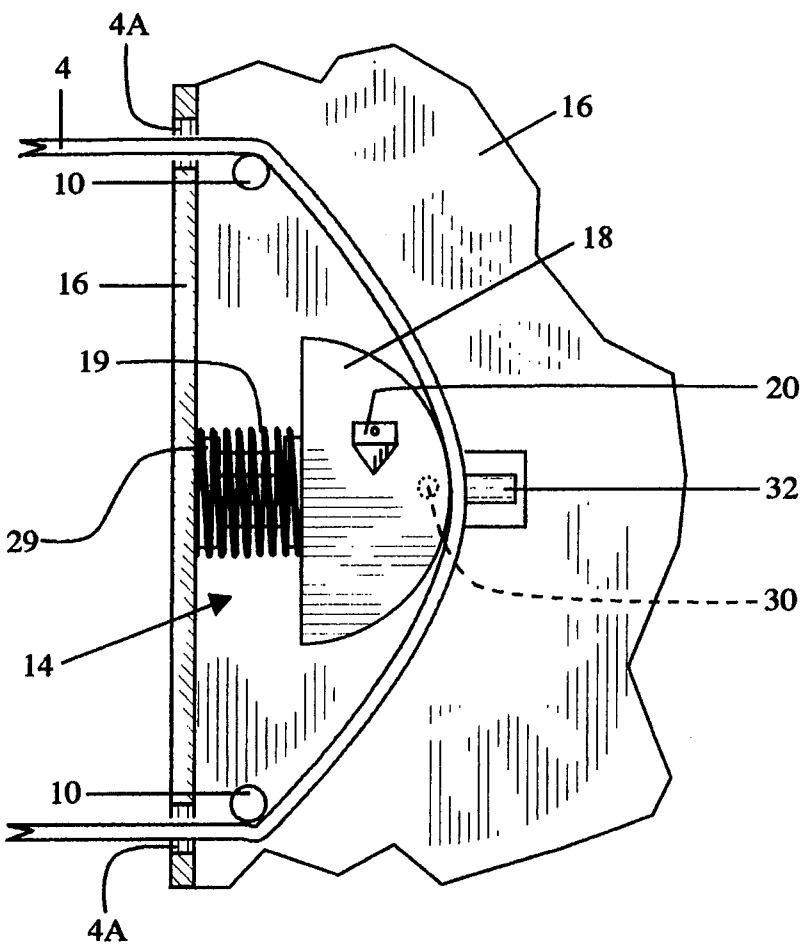

Referring to FIG. 6 the resistance meter assembly 14 is comprised of a pressure block 18 with its integral block pin 30 riding in a grooved slot 32, with a meter spring 19 and a spring retainer block 29, enclosed in the molded grip shell "B" 16. The pressure block 18 counteracts the resistance supplied by the meter spring 19 when the resistance band 4 is tightened by the user. A pointer 20, riveted to the pressure block 18, indicates to the user the relative resistance of the resistance band 4. The guides 10 spaces both upper and lower parts of the resistance band 4 between the resistance band cutouts 4A, while the spring retainer block 29 keeps the meter spring 19 in place.

Figure 7:
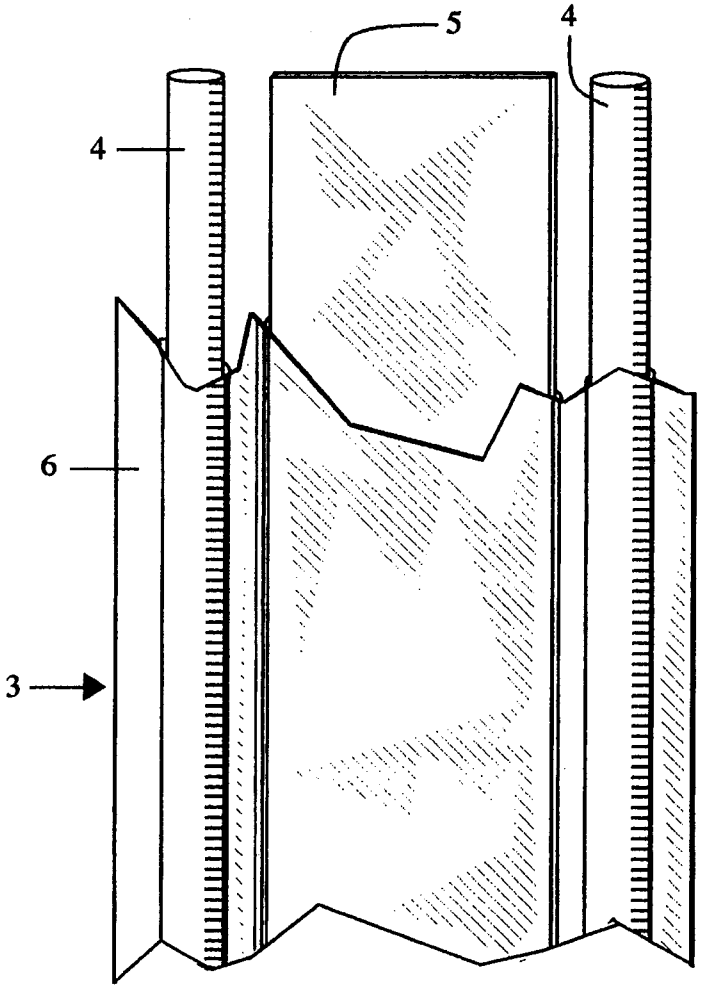

Referring to FIG. 7 the resistance band assembly 3 is comprised of the outer jacket 6, which acts as an outer cover, made of rubber or any suitable substance, and the hard rubber spine 5, made of hard rubber or any suitable substance, which is used to evenly space the resistance adjust handle 1 (FIG. 3) from the resistance meter handle 2 (FIG. 4), yet allows the device to flex during use. The resistance band 4 passes freely through the inside of the outer jacket 6.

Figure 8:
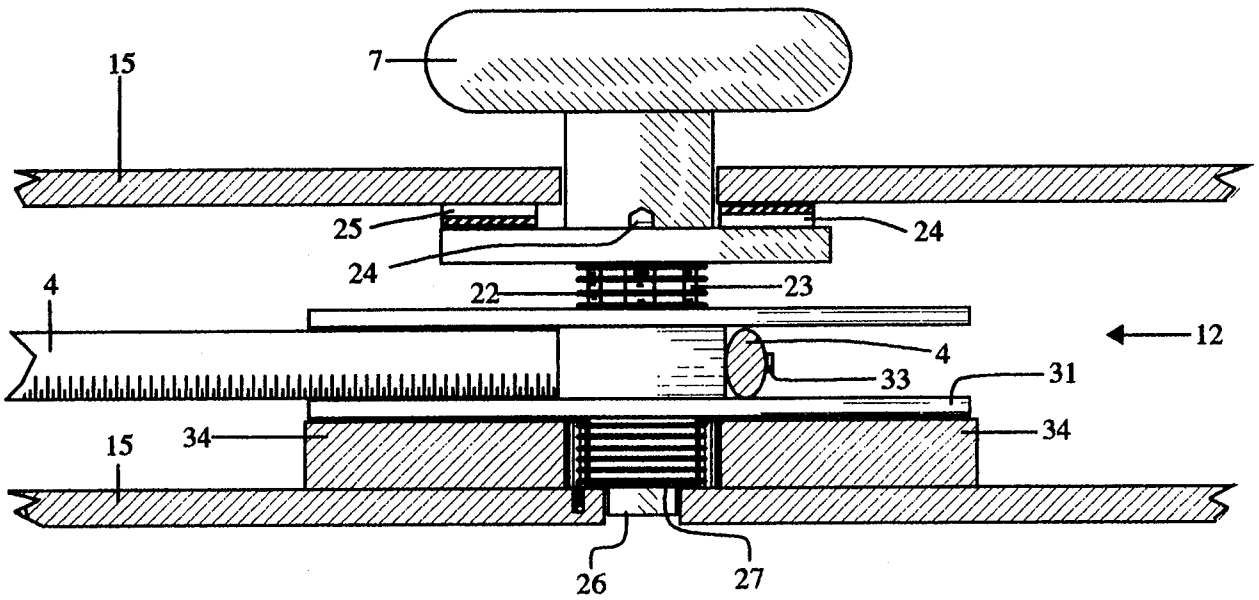
Figure 9:
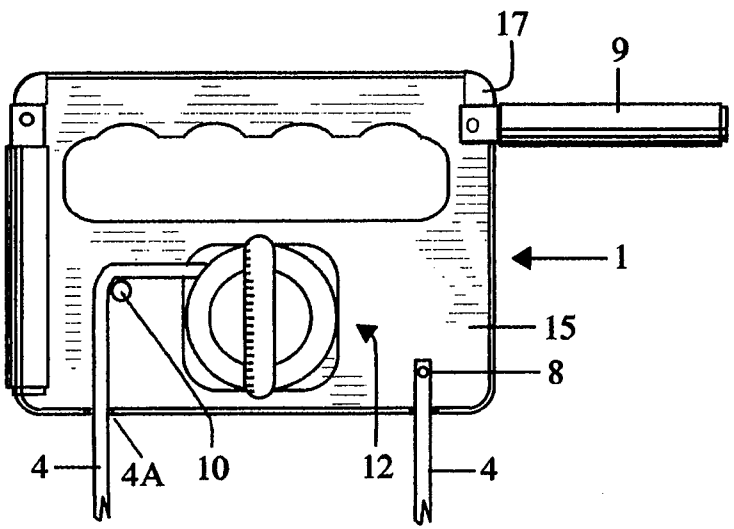

Referring to FIG. 8 is an additional embodiment of the resistance adjust assembly 12. The resistance adjust assembly 12 controls the tension of the resistance band 4 by the pushing down of the resistance adjust knob 7, which rides on the fluted shaft 23, against the pressure of the return spring 22, disengaging an ellipse of the upper teeth 25, attached to the molded grip shell "A" 15, from an ellipse of the lower teeth 24, attached to the lower section of the resistance adjust knob 7, with the rotation of the resistance adjust knob 7 turning the fluted shaft 23, which is firmly attached to a tension spool 31 by any convenient means, rotating the tension spool 31 either against the spring tension of the counter spring 27, if lowering tension of the resistance band 4, or with the spring tension of the counter spring 27, if increasing tension of the resistance band 4, thus increasing or decreasing the tension by the taking up or playing out of the resistance band 4 from the tension spool 31. The resistance band 4 is attached to the tension spool 31 by a screw, rivet, or any convenient means 33. The fluted shaft 23 is coupled and rotatable through the lower portion of the molded grip shell "A" 15 by an integral fluted shaft axle 26. Referring to FIG. 9 is an additional embodiment of the resistance adjust handle 1, comprising the additional embodiment of FIG. 8. The resistance adjust handle 1 is comprised of the hand grips 9, attached to the molded grip shell "A" 15 by pins, rivets or any convenient means, so as to be foldable from the molded grip shell "A" 15 and be held in a 90 degree angle from the molded grip shell "A" 15 by the pivot stop 17 or, when applicable, to be folded back into the molded grip shell "A" 15. The resistance adjust assembly 12 controls the tension of the resistance band 4 and is best shown is FIG. 8. The guide 10 spaces the lower section of the resistance band 4 between the resistance band cutout 4A and the resistance adjust assembly 12, while the top section of the resistance band 4 is held rigidly in place by a rivet 8.

OPERATION

Referring to the drawings in which like reference characters refer to like parts throughout the several views thereof, the manner of use of the invention is as follows:

A. Bench Press: With the invention lying fiat against a level surface, the user places his upper back on the middle area of the resistance band assembly 3, grips the resistance adjust handle 1 with one hand, and grips the resistance meter handle 2 with the opposing hand and, while in the prone position, extends both hands away from the body, thus fighting the resistance of the resistance band 4. The user then lowers his hands towards the chest while still gripping the resistance adjust handle 1 with one hand, and gripping the resistance meter handle 2 with the opposing hand. The user then continues to perform the standard bench press movements.

B. Arm Curl: The user extends the hand grips 9 and the foot rests 13 until the stops 17 block further movement of the hand grips 9 and the foot rests 13. The user, while in the standing position, places the foot rests 13 beneath the feet, grabs the hand grips 9 with the user's hands in an underhanded grip, and pulls up until the resistance adjust handle 1 touches the user's chest. User then extends his arms outward until his arms are fully extended forward, and continues to perform the standard arm curl movements.

C. Rowing: The user extends the hand grips 9 and the foot rests 13 until the stops 17 block further movement of the hand grips 9 and the foot rests 13. The user, while in the prone position with knees bent and arms extended outward frown the body, places the foot rests 13 beneath the feet, grabs the hand grips 9 with the hands in an over-handed or underhanded grip, and pulls the hand grips 9 toward user while extending legs outward in the standard rowing movement.

D. Leg Extensions: The user extends the hand grips 9 and the foot rests 13 until the stops 17 block further movement of the hand grips 9 and the foot rests 13. The user, while in the standing position, places the foot rests 13 beneath the feet, grabs the hand grips 9 with the hands in an underhanded grip and arms bent at the elbow, upper arm longitudinally oriented with the body and forearms placed 90 degrees from the body, and uses the legs in a squatting and un-squatting movement, keeping the arms rigid.

E. Shoulder Shrugs: The user extends the hand grips 9 and the foot rests 13 until the stops 17 block further movement of the hand grips 9 and the foot rests 13. The user, while in the standing position, places the foot rests 13 beneath the feet, grabs the hand grips 9 with the hands in an underhanded grip, and pulls against the resistance of the resistance band 4 with a shrugging movement of the shoulders.

F. Crunches: The user extends the hand grips 9 and the foot rests 13 until the stops 17 block further movement of the hand grips 9 and the foot rests 13. The user places the foot rests 13 beneath the feet, grabs the hand grips 9 with the hands in an underhanded grip and, while in the prone position with knees bent and arms contracted against the chest, performs the standard crunch movement.

G. Chest Pull: With the user standing upright, the user grips the resistance adjust handle 1 with one hand, and grips the resistance meter handle 2 with the opposing hand, and extends both hands away from each side of the body in the standard chest pull movement.

SUMMARY, RAMIFICATIONS, AND SCOPE

Thus the reader will see that the invention is versatile, lightweight, compact, portable, and easy to use.

Although the description above contains many specifications, these should not be construed as limiting the scope of the invention but merely providing illustrations of some of the preferred embodiments of this invention.

Thus the scope of the invention should be determined by the appended claims and their legal equivalents, rather than by the examples given.

I claim:

1. An exercise device, comprising:

a. molded grip shells comprising a plurality of hand grips and toot rests, and b. said molded grip shells attached to opposite ends of a set of resistance bands, and c. said resistance bands covered by a hard rubber spine, and d. said resistance bands connected to a single knob tension adjustment means integrated into one of said molded grip shells, comprised of a resistance adjust knob with an ellipse of lower teeth at its base, and an ellipse of upper teeth attached to the inner section of said grip shell, with said resistance adjust knob riding on a fluted shaft, with an inner roughened-surfaced wheel attached to said fluted shaft, and a return spring encompassing said fluted shaft, with said inner roughened surfaced wheel riding on the surface of a riser, and pinch guides attached to the top of said riser, with said resistance bands pinched between said pinch guides and said inner toughened-surfaced wheel, with a counter spring encircling the base of said fluted shaft, and an integral shaft axle attached to the bottom of said fluted shaft, with said integral shaft axle rotating in a cutout of said grip shell, and e. a resistance meter assembly integrated into the second of said molded grip shells comprised of a pressure block with attached pointer, a meter spring between said pressure block and the inside of said molded grip shells, and a resistance meter plate attached to the exterior of said molded grip shells, with said pointer indicating upon said resistance meter plate the resistance pressure as set by said single knob tension adjustment means.

* * * * *